US006394125B2

(12) United States Patent
White

(10) Patent No.: US 6,394,125 B2
(45) Date of Patent: May 28, 2002

(54) LEAK-CONTAINING SHEATH FOR FROST-RESISTANT HYDRANT

(75) Inventor: Paul R. White, Strafford, MO (US)

(73) Assignee: W. R. M. Investors, Inc., Springfield, MO (US)

( * ) Notice: Subject to any disclaimer, the term of this patent is extended or adjusted under 35 U.S.C. 154(b) by 0 days.

(21) Appl. No.: 09/800,852

(22) Filed: Mar. 7, 2001

Related U.S. Application Data

(60) Provisional application No. 60/188,066, filed on Mar. 9, 2000.

(51) Int. Cl.[7] ..... E03B 9/14

(52) U.S. Cl. ..... 137/312; 137/301; 137/360; 137/375; 138/32; 73/46; 73/49.1; 285/14; 285/125.1; 285/129.1

(58) Field of Search ..... 137/59, 61, 301, 137/302, 307, 308, 312, 360, 375; 138/32, 114; 73/40.5 R, 46, 49.1; 285/13, 14, 125.1, 129.1

(56) References Cited

U.S. PATENT DOCUMENTS

| | | | | |
|---|---|---|---|---|
| 536,801 | A | 4/1895 | Gaghan | 137/360 |
| 3,952,770 | A | 4/1976 | Botnick | 137/360 |
| 4,158,366 | A | 6/1979 | Van Meter | 137/360 |
| 4,221,233 | A | 9/1980 | Botnick | 137/218 |
| 4,286,616 | A | 9/1981 | Botnick | 137/327 |
| 4,314,580 | A | 2/1982 | Steinwand | 137/312 |
| 4,473,244 | A | 9/1984 | Hill | 137/360 |
| 4,538,637 | A | 9/1985 | Williams | 137/360 |
| 5,012,833 | A | 5/1991 | Hunley, Jr. et al. | 137/15 |
| 5,392,805 | A | 2/1995 | Chrysler | 137/218 |
| 5,614,119 | A | 3/1997 | Ollis | 219/385 |

*Primary Examiner*—George L. Walton
(74) *Attorney, Agent, or Firm*—Jonathan A. Bay

(57) ABSTRACT

A combination sheath and frost-resistant wall hydrant include a hydrant having a wall-penetrating conduit and intermediate wall bracket. There is an internal valve seat between the bracket and indoor or inlet end, and so is located in a presumptively warm indoor climate and spaced back from the wall and/or outdoors so as to reduce chances of freezing outdoor temperatures freezing water stopped behind the valve seat. The sheath telescopes over the hydrant's inlet end until the sheath's leading end mates against the hydrant's bracket. The leading end is vented for venting leakwater from the hydrant outdoors and not indoors in cases if the hydrant bursts by freezing because water got stopped in the conduit between the valve seat and outlet and failed to drain despite an open outlet. The sheath's trailing end seals onto the hydrant somewhere behind the valve seat.

15 Claims, 3 Drawing Sheets

10
12
14
16
18
20
22
24
26
28
30
32
34
36
38
40
42
44
46
48
50
52
54

LEAK-CONTAINING SHEATH FOR FROST-RESISTANT HYDRANT

CROSS-REFERENCE TO PROVISIONAL APPLICATION(S)

This application claims the benefit of U.S. Provisional Application No. 60/188,066, filed Mar. 9, 2000.

BACKGROUND OF THE INVENTION

1. Field of the Invention

The invention generally relates freeze-resistant wall hydrants that provide an outdoor faucet from indoor plumbing and the like, and more particularly to a leak-containing sheath for such freeze-resistant hydrants just in case of freezing in any event, and the consequent bursting and leaks which follow. Additional aspects and objects of the invention will be apparent in connection with the discussion further below of preferred embodiments and examples.

2. Prior Art

Freeze-resistant hydrants are known, including what is shown by U.S. Pat. No. 5,392,805—Chrysler, entitled "Frost-resistant Hydrant." The Chrysler hydrant is provided for mounting to an outdoor wall and providing an outdoor faucet from indoor plumbing. The hydrant 20 is called "frost-resistant" because the valve stem thereof is lengthy so that the valve seat can be located deep indoors. Presumptively, any residue tapwater remaining in lengthy valve-stem chamber is free to drain out the faucet's outlet.

Hence during freezing weather the lengthy valve-stem chamber has hopefully drained dry. The frost or frost line might likely not extend back in the long valve-stem chamber from the outdoors, as far indoors as the valve seat.

Nevertheless problems are experienced with the prior art frost-resistant hydrants. Problems most often arise, among other causes, when a garden hose or the like is left attached to faucet's outlet. The attached garden hose might be accidentally left full with water. In which case, that will plug the frost-resistant hydrant and prevent the tapwater backed-up in the lengthy valve-stem chamber, from draining out the hydrant's outlet. Again, the hydrant's outlet is effectively "plugged" by virtue of having connected to it a full hose. Comes the freezing weather, and the tapwater trapped in the lengthy valve-stem chamber will indeed freeze. Freezing bursts the hydrant despite its design to prevent this. A burst hydrant consequently leaks after thawing.

The leaks are virtually always indoors, not outdoors. For residential homeowners, the leaks may go undetected for quite some extended time period. The experience of one actual homeowner serviced by the inventor's plumbing company is representative of the experience of numerous others. This actual homeowner incurred a $1,500 leak-water damage bill despite having taken the precaution to install freeze-resistant hydrants for all his outdoor hydrants.

What is needed is an improvement which addresses the shortcomings of the prior art.

SUMMARY OF THE INVENTION

It is an object of the invention to provide a back-up safety measure for frost- or freeze-resistant hydrants in cases where they are burst by freeze or frost nevertheless.

It is an alternate object of the invention that the above back-up safety measure be shaped to operatively couple with many or most of the given frost- or freeze-resistant hydrants. In other words, the invention is not a substitute for the hydrant. Rather, the invention is an enhancement to the given hydrant.

It is another object of the invention that the above back-up safety measure cost less than if not a fraction of the cost of the given hydrant, and be easy to insert in the pre-established piping of the hydrant with the indoor plumbing.

These and other aspects and objects are provided according to the invention in a combination leak-containing sheath and frost-resistant wall hydrant. The frost-resistant wall hydrant comprises a wall-penetrating conduit and an actuating member. The wallpenetrating conduit extends between an indoor inlet end and an outdoor apertured actuator end. The conduit has a wall-mounting flange affixed to it in between its outdoor and indoor ends. The conduit is also provided with a lateral outlet that discharges to the outdoors. It is also formed with an internal valve seat in between the flange and the inlet end. The actuating member comprises an elongated shaft that extends through the apertured actuator end of the conduit to terminate inside the conduit in a valving member that is movable axially relative to the inlet valve seat. The actuating member terminates outdoors in a hand-portion that allows operative actuation and hence affords the opening and closing of the valving member relative to the inlet valve seat.

Given the foregoing, the valve seat is located in a presumptively above-freezing indoor climate and spaced back from the wall flange and hence the outdoors so as to reduce the chances of freezing outdoor temperatures from freezing any water stopped behind the valve seat.

It is an aspect of the invention that the foregoing frost-free wall hydrant is combined with a leak-containing sheath. The sheath extends between spaced open ends of which one is formed with a peripheral rim and the other is formed internally with coupling structure. The sheath and open rimmed end are sized wide enough to telescope over the hydrant's inlet end until the sheath's rim mates against the hydrant's flange. The sheath is axially sized such that with the rimmed end abutting the hydrant's flange the internal coupling structure is located to couple and seal with the hydrant's inlet end. The sheath's rimmed end is formed with a vent for venting leakwater from the hydrant outdoors and not indoors in cases if the hydrant leaks as being burst by freezing because water got stopped in the conduit between the valve seat and outlet and failed to drain despite an open outlet.

The vent arrangement optionally comprises one or more spoke-like grooves recessed in the rim and thereby forming a water passage between the sheath's hollow interior and the outdoors. The sheath's coupling structure further includes terminal structure adapted for coupling to an indoor plumbing line.

The hand-portion might comprise a handle and operative actuation comprises twisting. The apertured outdoor end comprises internal thread and packing to form a leak-free operative seal with the valve shaft which is formed with corresponding external thread. On the opposite end, the valving member forms a conic plug and the valve seat forms a corresponding countersunk ring for tightly mating with the valving member. Accordingly, the conic plug has a smaller outside diameter than the conduit's inside diameter in order to allow annular flow thereby.

The hydrant's indoor inlet end can be arranged to terminate in an externally threaded portion and the sheath's corresponding coupling structure would therefore include an internally threaded socket for accepting the hydrant's externally threaded portion. Preferably, the lateral outlet forms a spigot with external thread adapted for connecting to garden hose and the like.

Additional aspects and objects of the invention will be apparent in connection with the discussion further below of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
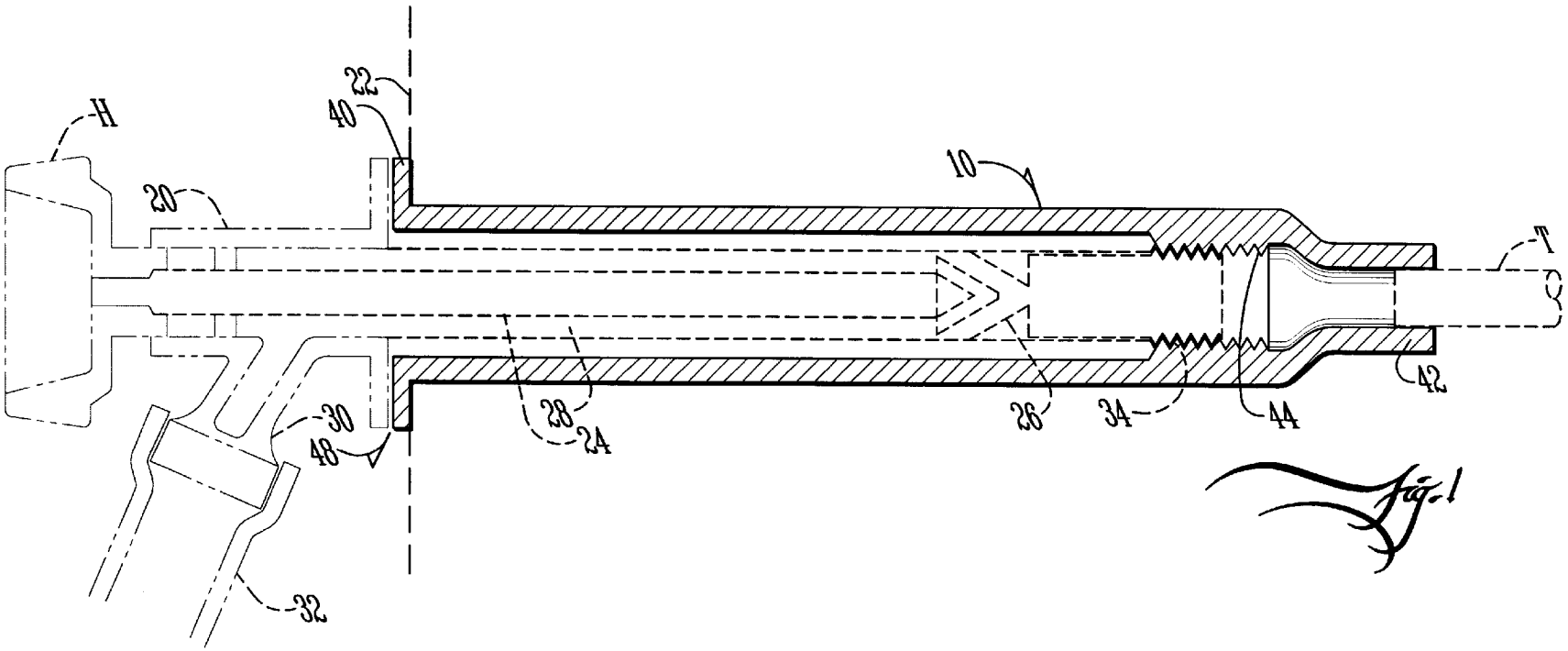
FIG. 1 is a section view of a leak-containing sheath in accordance with the invention, taken along a vertical plane of symmetry through a central axis thereof, for containing leaks in frost- or freeze-resistant hydrants, one example of which is shown in dot-dash lines to illustrate the operative use environment for the invention.
Figure 2:
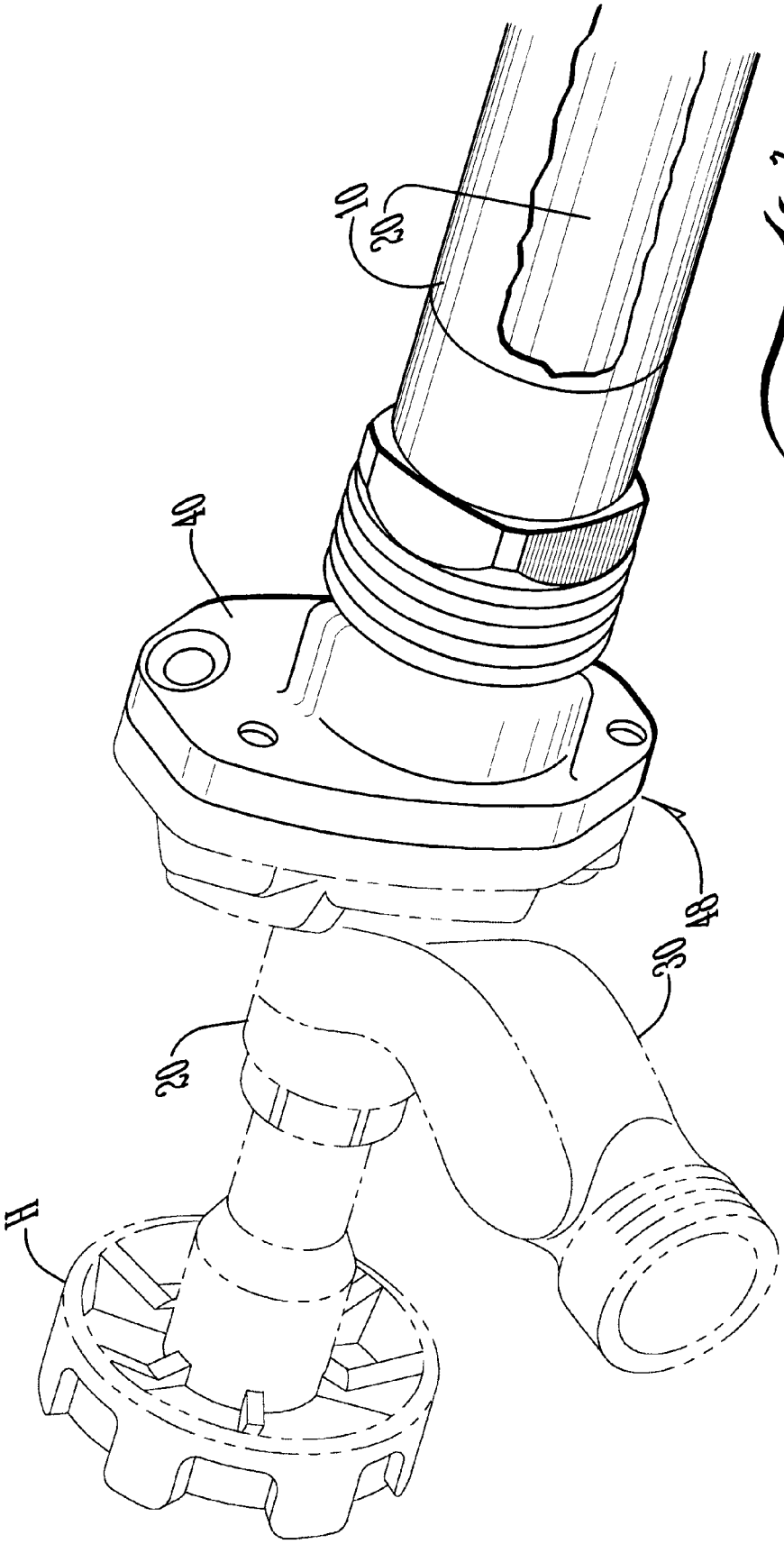
FIG. 2 is a perspective view, with potions broken away, of the outdoor mounting end thereof; and, FIG. 3 is a perspective view, with potions broken away, of the indoor coupling end thereof.

FIG. 1 shows a sheath 10 in accordance with the invention, for containing leaks (if any should develop) in an outdoor hydrant of the type used to provide an outdoor tap from indoor plumbing. Such hydrants are commonly found provided with, among other type of structures, residential homes. In the more preferred use environment, the sheath 10 is utilized to surround a special outdoor faucet that is known variously as frost- or freeze-resistant hydrants, one example of which is indicate as 20 in the drawings.

Frost-resistant hydrants 20 cause various miseries for homeowners, as the inventor has observed from the vantage of his plumbing service, because they provide a false sense of security that they are freeze-proof. However, there are ways in which their frost- or freeze-resistant safety features can be frustrated. When frost-resistant hydrants do indeed freeze, they may leak undetected for quite an extended length of time. Leaks in frost-resistant hydrants seem to catch homeowners by great surprise. Such homeowners are especially aggravated because they believed they had foreseen and addressed that problem of freezing hydrants in advance, and solved it for all times. The economic measure of water damage varies with what got soaked and destroyed. It never is accepted cheerfully regardless if even the damage is rather slight.

In the drawings, a representative frost-resistant hydrant 20 is shown in dot-dash lines. This very particular hydrant 20 is more exactly shown by U.S. Pat. No. 5,392,805—Chrysler, entitled "Frost-resistant Hydrant," the disclosure of which is incorporated by this reference to it. This example frost-resistant hydrant 20 of like hydrants (eg., a.k.a. "freeze-resistant" or "no freeze" and "freeze proof" and so on) is chosen merely for convenience of a representative example, the production of the sheath 10 allowing proportioning and customizing to work with about all forms of such hydrants now or hereafter known, and accordingly, the adoption of this hydrant 20 for use in the drawings does not limit the inventive sheath 10 to it alone.

In view of the foregoing, the given hydrant 20 is mounted with its handle "H" extending outdoors from exterior wall 22 of a building. The hydrant 20 is called "frost-resistant" because the valve stem 24 is sufficiently elongated so that the valve seat 26 can be located deep indoors. Any residue tapwater remaining in correspondingly elongated valve-stem chamber 28 is free to drain out the faucet-outlet 30. Presumptively, during freezing weather, the elongated valve-stem chamber 28 would hopefully have drained dry. That way, the frost line likely won't extend back from the outdoors as far as indoors as the valve seat 26.

Nevertheless problems are experienced with the frost-resistant hydrants. Problems are most often caused by, among other causes, leaving a hose 32 attached to the faucet-outlet 30. The hose 32, if left full of water and not drained, effectively plugs the hydrant 20. The full hose 32 thus prevents tapwater from draining out the valve-stem chamber 28. In freezing weather, tapwater trapped in the valve-stem chamber 28 will indeed freeze, and burst the hydrant 20 despite the hydrant 20 being specifically designed to resist freezing.

Figure 3:
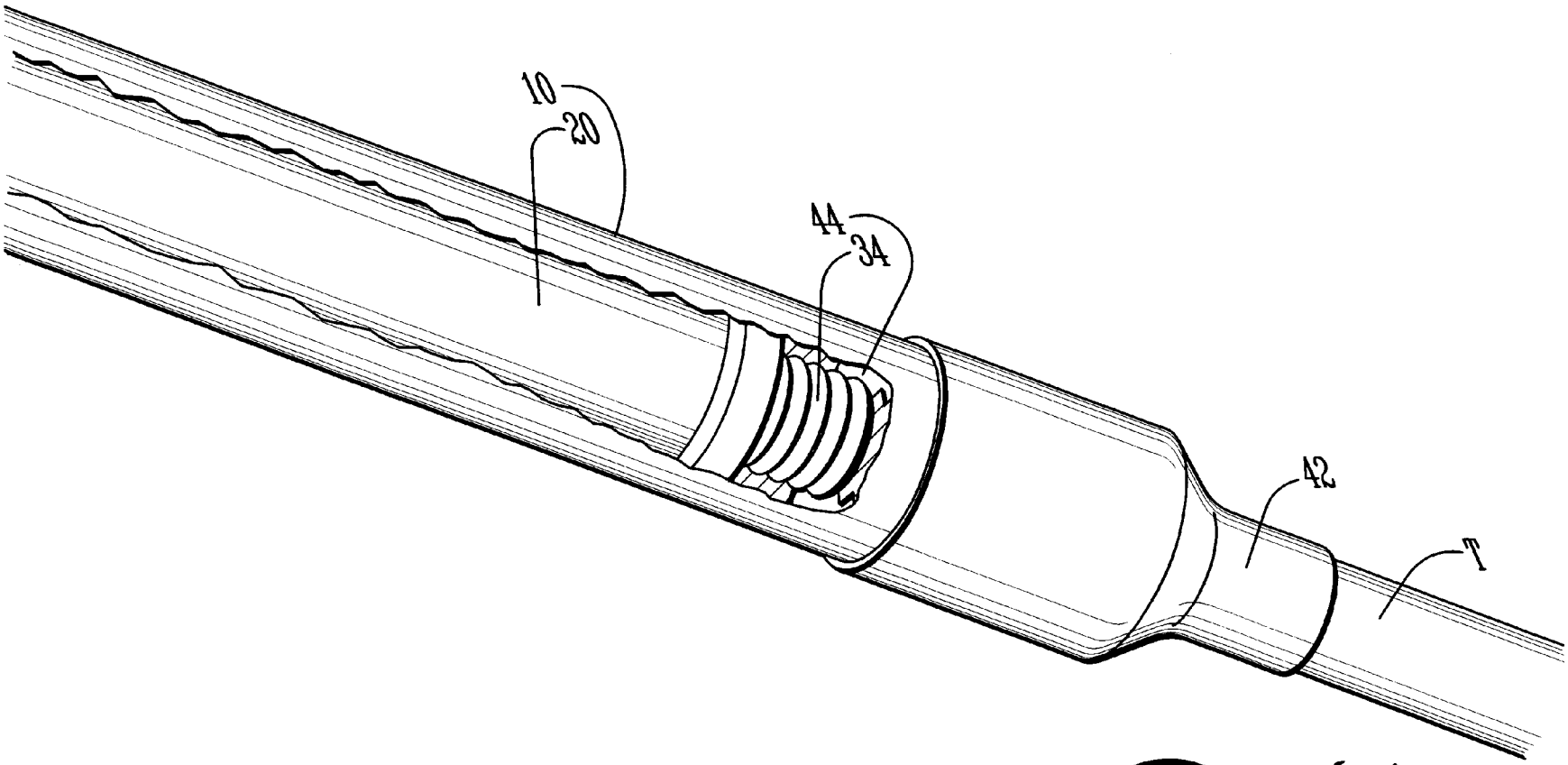

The inventive sheath 10 takes substantially the format of an oversized tube installed surrounding and enclosing the frost-resistant hydrant 20. The inventive sheath 10 extends between a flanged-end 40 and an opposite reduced-down bell-end 42 for a solder connection with indoor piping "T" (see, eg., FIG. 3) The bell-end 42 flares out in the direction toward the flanged-end 40 to allow formation of internal-thread socket 44. The given hydrant 20 has an external-thread fitting 34 which screws into internal-thread socket 44. To turn to the flanged-end 40, it either has a drain-hole formed in it (not shown by the drawings) or else it defines a gap 48 with the hydrant 20's corresponding flange. In use, the sheath 10 collects unwanted leakwater leaking out of a burst hydrant 20 in the indoor domain of the hydrant 20, which leakwater is drained outdoors by drain-gap 48. Also, the inventive sheath 10 allows quick replacement of a defective hydrant 20 by virtue of screw fitting 34/44.

It is an inventive aspect of the sheath 10 that it contains leaks in such frost-resistant hydrants 20 after they have failed their purpose (eg., been burst by ice).

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A combination leak-containing sheath and frost-resistant wall hydrant comprising:

a frost-resistant wall hydrant having: a metal, wall-penetrating conduit extending between an indoor inlet end provided with an externally-threaded portion and an outdoor apertured actuator end; a wall-mounting flange affixed to the conduit intermediate the outdoor and indoor ends, wherein said conduit is provided with a lateral outlet that discharges to the outdoors and is formed with an internal valve seat intermediate the flange and inlet end; an actuating member comprising an elongated shaft that extends through the apertured actuator end to terminate inside the conduit in a valving member that is movable axially relative to the inlet valve seat, and terminating outdoors in a hand-portion allowing operative actuation and hence opening and closing the valving member relative to the inlet valve seat; whereby the valve seat is located in a presumptively above-freezing indoor climate and spaced back from the wall flange and hence the outdoors so as to reduce the chances of freezing outdoor temperatures from freezing any water stopped behind the valve seat; and a leak-containing sheath being a device having a metal tubular body extending between spaced open ends of which one end is fitted with a peripheral rim-forming fitting and the other end forms a reduced-down-bell formation the very termination of which is cylindrically hollow, sized and adapted for a solder connection with a given indoor plumbing line, said rim-forming fitting and that much of the tubular body that excludes the reduced-down-bell formation defining a lumen being diametrically sized to telescope over the hydrant's inlet end until the sheath's rim-forming fitting mates against the hydrant's flange, wherein said reduced-down-bell formation internally flares out in the direction toward the end with the rim-forming fitting and being formed with an internally-threaded portion for the externally-threaded portion of the hydrant's inlet end to screw into and correspondingly said sheath device is axially sized such that with the rim-forming fitting abutting the hydrant's flange the reduced-down-bell formation's internally-threaded portion allows a screw connection and seal with the hydrant's inlet end's externally-threaded portion, wherein said sheath's rim-forming fitting is formed with a vent for venting leakwater from the hydrant outdoors and not indoors in cases if the hydrant leaks as being burst by freezing because water got stopped in the conduit between the valve seat and outlet and failed to drain despite an open outlet.

2. The combination leak-containing sheath and frost-resistant wall hydrant of claim 1 wherein the vent comprises one or more spoke-like grooves recessed in the rim-forming fitting and thereby forming a water passage between the sheath's hollow interior and the outdoors.

3. The combination leak-containing sheath and frost-resistant wall hydrant of claim 1 wherein the hand-portion comprises a handle and operative actuation comprises twisting.

4. The combination leak-containing sheath and frost-resistant wall hydrant of claim 3 wherein the apertured outdoor end comprises internal thread and packing to form a leak-free operative seal with the valve shaft which is formed with corresponding external thread.

5. The combination leak-containing sheath and frost-resistant wall hydrant of claim 1 wherein the valving member form s a conic plug and the valve seat forms a corresponding countersunk ring for tightly mating with the valving member, whereby the conic plug has a smaller outside diameter than the conduit's inside diameter in order to allow annular flow thereby.

6. The combination leak-containing sheath and frost-resistant wall hydrant of claim 1 wherein the lateral outlet forms a spigot with external thread adapted for connecting to garden hose.

7. A combination leak-containing sheath and frost-resistant wall hydrant comprising:

a frost-resistant wall hydrant having: a metal, wall-penetrating conduit extending between an indoor inlet end provided with an externally-threaded portion and an outdoor apertured actuator end; a wall bracket on the conduit intermediate the outdoor and indoor ends, wherein said conduit is provided with a lateral outlet that discharges to the outdoors and is formed with an internal valve seat intermediate the bracket and inlet end; an actuating member comprising an elongated shaft that extends through the apertured actuator end and from there is operatively linked to a termination inside the conduit that forms a valving member that is movable axially relative to the inlet valve seat, said elongated shaft terminating outdoors in a hand-portion allowing operative actuation and hence opening and closing the valving member relative to the inlet valve seat; whereby the valve seat is located in a presumptively above-freezing indoor climate and spaced back from the wall and hence the outdoors so as to reduce the chances of freezing outdoor temperatures from freezing any water stopped behind the valve seat; and a leak-containing sheath being a device having a metal tubular body extending between spaced open ends of which one end is fitted with an abutment structure and the other end forms a reduced-down-bell formation the termination of which is cylindrically hollow and sized as well as adapted for a solder connection with a given indoor plumbing line, said abutment structure and that much of the tubular body that excepts the reduced-down-bell formation defining a lumen being diametrically sized to telescope over the hydrant's inlet end until the sheath's abutment mates against the hydrant's bracket, wherein said reduced-down-bell formation internally flares out in the direction toward the end with the abutment structure and being formed with an internally-threaded portion for the externally-threaded portion of the hydrant's inlet end to screw into and accordingly said sheath device is axially sized such that with the abutment structure abutting the hydrant's bracket the reduced-down-bell formation's internally-threaded portion allows a screw connection and seal with the hydrant's inlet end's externally-threaded portion, wherein said sheath's abutment end is formed with a vent for venting leakwater from the hydrant outdoors and not indoors in cases if the hydrant leaks as being burst by freezing because water got stopped in the conduit between the valve seat and outlet and failed to drain despite an open outlet.

8. The combination leak-containing sheath and frost-resistant wall hydrant of claim 7 wherein the vent comprises one or more spoke-like grooves recessed in the sheath's abutment end and thereby forming a water passage between the sheath's hollow interior and the outdoors.

9. The combination leak-containing sheath and frost-resistant wall hydrant of claim 7 wherein the hand-portion comprises a handle and operative actuation comprises twisting.

10. The combination leak-containing sheath and frost-resistant wall hydrant of claim 9 wherein the apertured outdoor end comprises internal thread and packing to form a leak-free operative seal with the valve shaft which is formed with corresponding external thread.

11. The combination leak-containing sheath and frost-resistant wall hydrant of claim 7 wherein the valving member forms a conic plug and the valve seat forms a corresponding countersunk ring for tightly mating with the valving member, whereby the conic plug has a smaller outside diameter than the conduit's inside diameter in order to allow annular flow thereby.

12. The combination leak-containing sheath and frost-resistant wall hydrant of claim 7 wherein the lateral outlet forms a spigot with external thread adapted for connecting to garden hose.

13. A combination leak-containing sheath and frost-resistant wall hydrant comprising:

a frost-resistant wall hydrant having: a metal, wall-penetrating conduit extending between an indoor inlet end provided with an externally-threaded portion and an outdoor apertured actuator end; a wall bracket on the conduit intermediate the outdoor and indoor ends, wherein said conduit is provided with a lateral outlet that discharges to the outdoors and is formed with an internal valve seat intermediate the bracket and inlet end; an actuating member comprising an elongated shaft that extends through the apertured actuator end and from there is operatively linked to a termination inside the conduit that forms a valving member that is movable axially relative to the inlet valve seat, said elongated shaft terminating outdoors in a hand-portion allowing operative actuation and hence opening and closing the valving member relative to the inlet valve seat; whereby the valve seat is located in a presumptively above-freezing indoor climate and spaced back from the wall and hence the outdoors so as to reduce the chances of freezing outdoor temperatures from freezing any water stopped behind the valve seat; and a leak-containing sheath being a device having a metal tubular body extending between spaced open ends of which one end is fitted with an abutment structure and the other end forms a reduced-down-bell formation the termination of which is cylindrically hollow and sized as well as adapted for a solder connection with a given indoor plumbing line, said abutment structure and that much of the tubular body that excepts the reduced-down-bell formation defining a lumen being diametrically sized to telescope over the hydrant's inlet end until the sheath's abutment mates against the hydrant's bracket, wherein said reduced-down-bell formation internally flares out in the direction toward the end with the abutment structure and being formed with an internally-threaded portion for the externally-threaded portion of the hydrant's inlet end to screw into and accordingly said sheath device is axially sized such that with the abutment structure abutting the hydrant's bracket the reduced-down-bell formation's internally-threaded portion allows a screw connection and seal with the hydrant's inlet end's externally-threaded portion, wherein said sheath's abutment end is formed with a vent for venting leakwater from the hydrant outdoors and not indoors in cases if the hydrant leaks as being burst by freezing because water got stopped in the conduit between the valve seat and outlet and failed to drain despite an open outlet.

14. The combination leak-containing sheath and frost-resistant wall hydrant of claim 13 wherein the vent comprises one or more spoke-like grooves recessed in the sheath's abutment end and thereby forming a water passage between the sheath's hollow interior and the outdoors.

15. The combination leak-containing sheath and frost-resistant wall hydrant of claim 13 wherein the lateral outlet forms a spigot with external thread adapted for connecting to garden hose.

* * * * *